US005671817A

United States Patent [19]

Smith et al.

[11] Patent Number: 5,671,817

[45] Date of Patent: Sep. 30, 1997

[54] DRILL BIT WITH DUAL REAMING ROWS

[75] Inventors: Roger C. Smith, Houston; Charles W. Stafford, Spring, both of Tex.

[73] Assignee: Camco International Inc., Houston, Tex.

[21] Appl. No.: 540,685

[22] Filed: Oct. 2, 1995

[51] Int. Cl.[6] ..... E21B 10/16

[52] U.S. Cl. ..... 175/374; 175/378; 175/408

[58] Field of Search ..... 175/374, 378, 175/406, 408

[56] References Cited

U.S. PATENT DOCUMENTS

| | | | |
|---|---|---|---|
| 3,727,705 | 4/1973 | Newman | 175/374 |
| 3,952,815 | 4/1976 | Dysart | 175/374 |
| 4,058,177 | 11/1977 | Langford, Jr. et al. | 175/374 |
| 4,231,438 | 11/1980 | Garner et al. | 175/353 |
| 4,832,139 | 5/1989 | Minikus et al. | 175/374 |
| 4,940,099 | 7/1990 | Deane et al. | 175/374 |
| 5,351,770 | 10/1994 | Cawthrone et al. | 175/374 |
| 5,353,885 | 10/1994 | Hopper, et al. | 175/378 |
| 5,407,022 | 4/1995 | Scott et al. | 175/374 X |
| 5,542,485 | 8/1996 | Pessier et al. | 175/371 |

FOREIGN PATENT DOCUMENTS

| | | | |
|---|---|---|---|
| 802502 | 2/1981 | U.S.S.R. | 175/378 |

*Primary Examiner*—Hoang C. Dang

[57] ABSTRACT

A rolling cutter drill bit has multiple rows of gage reaming inserts mounted in the gage face of the cutters. A first interlocking row of gage reaming inserts is positioned on the gage face of a cutter in close proximity to the gage row, such that the reaming inserts are closely adjacent to the mouth of the gage insert sockets. A second non-interlocking row of gage reaming inserts is positioned on the gage face of the cutter such that the reaming insert sockets are a predetermined minimum distance from the gage insert sockets and first reaming row sockets, thereby enabling a maximum number of large diameter reaming inserts to be placed in the second reaming row. Both the first and second reaming row inserts are sized and placed to maintain a desired distance between all insert sockets without affecting the size and spacing of gage row inserts.

16 Claims, 4 Drawing Sheets

DRILL BIT WITH DUAL REAMING ROWS

BACKGROUND OF THE INVENTION

1. Field of the Invention

This invention relates to the cutting structure design of rolling cutter bits for drilling holes in earthen formations. More specifically, this invention addresses the gage reaming structure located on the outer surfaces of insert type rolling cutter rock bits.

2. Related Art

One of the most important requirements of a rock bit in drilling a well for oil or gas is that it must drill a proper diameter or "full-gage" wellbore. Many problems emerge when a bit leaves an under gage hole having a bore diameter smaller than desired. In some applications, the drill string components just above the bit at the bottom of the drill string can become wedged into an under gage hole, thereby limiting drilling progress or even causing a stuck drill string. Time-consuming reaming operations are often required to return to bottom with a new bit. The new bit can be subjected to premature wear even before drilling progress begins at the hole bottom. In directional drilling environments, the borehole can be misdirected from its intended path because the clearance between the drilled borehole wall and the near-bit drill string components affects the degree of directional build of the well bore. In addition, completion casing may not fit into an under gage hole. Therefore, it is a prime requirement that bits exhibit minimal gage diameter wear throughout the entire drilling operation.

Although many enhancements have been made to modem roller cone bits, they still suffer premature gage wear, particularly when drilling hard and abrasive formations. The rolling cutters have an outer gage face positioned approximately parallel to the lower portion of the borehole sidewall. The gage face of each cutter slides against the sidewall during drilling with a high drag, reaming action. The hardened steel gage face surfaces of the cutter are thereby subject to the abrasive action of the formation, resulting in removal of material around and between the insert cutting teeth. If the thickness of supporting cutter steel material near an insert is reduced due to wear, the imposed drilling loads can pry the insert loose from its retaining socket. Loose inserts are then drilled by the bit, causing loss and fracture of other inserts. A cascading effect of insert loss leading to further insert loss and fracture can lead to very rapid bit failure. To avoid this failure, it is important to limit the removal of cutter steel material near the mouth of the insert receiving sockets, particularly at the mouth of the gage insert sockets. Therefore, supplementary rows of gage reaming inserts are typically positioned on the outer gage surface of the cutters to limit wear of the gage face.

These supplementary gage reaming inserts also prolong gage life after the primary gage inserts have become worn. The reaming inserts are positioned on the bit to ream the borehole wall to full diameter. They are typically made of harder, more abrasion resistant material than the gage inserts, so they wear at a slower rate than the gage inserts, thereby extending the useful gage life of the bit. In abrasive drilling environments, gage life can be optimized by maximizing the exposed wear-resistant area of supplementary gage reaming inserts on the cutter gage faces. To understand the structure of the cutting elements on the gage reaming face of the cutter, one must first examine the structure of the rows of inserts which drill the hole bottom and gage corner. Modern drill bits are designed with rows of protruding inserts positioned at different locations on each cutter to facilitate intermeshing between inserts of adjacent cutters when the bit is assembled. Although the insert rows adjacent to the gage row are intermeshed, the gage rows typically are not. This allows the use of a gage insert row at a common location on all three cutters. In most drilling environments, the gage insert rows of a bit experience accelerated wear and fracture because they are subject to dual cutting actions. They must cut the outer periphery of the hole bottom with a relatively low velocity, high penetration cutting action. They must also ream the lower portion of the side wall with a contrasting high velocity, low penetration cutting action. Therefore, a design goal for most bits is to maximize the number of gage inserts, particularly on bits designed to drill hard or abrasive formations. Since the gage rows are not intermeshing, a row of gage inserts is included on each cutter to maximize gage insert count.

A constraint to maximizing gage insert count is that a minimum distance must be maintained between the insert receiving sockets to avoid cracking between sockets. In addition, at least one cutter must have an inner row positioned adjacent to the gage row to insure complete coverage of insert impacts on the hole bottom. Typically the inserts of this inner row and the inserts of the adjacent gage row are spaced alternately around the periphery of the cutter. There are fewer inserts in the inner row than would normally be used if the inner row was not located in close proximity to the gage row. Likewise, there are fewer inserts in the gage row than on the gage rows of other cutters to maintain a minimum distance between gage and inner row insert sockets. These rows are said to be "interlocked".

An interlocked row is any insert row positioned in close proximity to an adjacent insert row such that the available locations of inserts around the interlocked row are limited by the proximity of insert sockets of the adjacent row. The circumferential positions around the interlocked row are limited because a minimum distance must be maintained between interlocked row sockets and adjacent row sockets to avoid cutter cracking. To avoid insert socket interference, inserts in an interlocked row are usually spaced alternately with inserts of the adjacent row. In some cases the diameter and depth of interlocked row sockets can also be limited by the proximity of the adjacent row. In contrast, a cutter with a "non-interlocked" gage row has no adjacent inner rows near the gage row. This allows the gage inserts to be positioned without regard to the position of inserts on any other row. The majority of roller cone bits in use today have at least one cutter with an interlocked gage row and at least one cutter with a non-interlocked gage row. An additional benefit of this arrangement is that interlocked and non-interlocked rows have different spacing between the insert cutting tips. This varied spacing minimizes tracking of the gage inserts of one cone into the craters left on the hole bottom by the previous cone.

The addition of supplementary gage reaming insert rows on the cutter gage face is secondary to the proper sizing and placement of gage inserts, hence the configuration of the gage inserts limits the sizing and placement of inserts in reaming rows. An additional constraint on the placement of reaming inserts is the length of the gage face itself. The gage face length is often limited by the need for large seal and bearing diameters, particularly on small diameter bits. Due to these space constraints, it is difficult for the bit designer to simultaneously provide a large number of adequately sized gage reaming inserts and position the reaming inserts near the mouth of the gage insert sockets. This is particularly difficult with only one row of reaming inserts. U.S. Pat. No. 3,727,705 shows a bit with large diameter reaming inserts on one cutter having wide gage insert spacing combined with small diameter reaming inserts on a second cutter having narrow gage insert spacing. This increases the amount of gage reaming carbide compared to that which is possible using only the smaller diameter reaming inserts. U.S. Pat. No. 3,952,815 and 5,353,885 show supplementary small diameter inserts positioned not on the gage face, but on the gage row surface of the cutter between the mouth of gage insert sockets. Although these supplementary inserts serve to reduce wear of the cutter steel at the mouth of gage insert sockets, the overall drilling effectiveness of the bit may be reduced because the number of gage inserts must be decreased to provide room for the supplementary insert sockets. In addition, the sockets required to receive these supplementary inserts preclude the use of reaming inserts positioned on the gage face between gage inserts.

U.S. Pat. No. 4,231,438 shows a "straight hole" bit with cutters having a flat profile with an enlarged cutter diameter at the gage insert row. This design facilitates an elongated gage face with room for two rows of reaming inserts. While there is an increased number of wear-resistant inserts on the gage face, the flattened profile changes the drilling action of the gage inserts and is not well optimized for the majority of drilling environments.

What is needed is a drill bit with an increased density of reaming inserts on the gage face without compromise to the size or spacing of the gage inserts and without compromise to the cutting structure profile. A design which provides protection of the gage face near the mouth of the gage insert sockets is particularly desirable.

SUMMARY OF THE INVENTION

The invention provides a rolling cutter drill bit for forming bore holes in earthen formations having a plurality of rolling cone cutters, at least one of said cutters having a gage face adapted to engage the sidewall of the bore hole, said one of said cutters having multiple rows of inserts retained in receiving sockets on the outer surfaces of the cutter, including: a gage row of inserts positioned adjacent to said gage face to engage the outer periphery of the hole bottom; a first reaming row of inserts positioned on said gage face of said cutter in an interlocking relationship with said gage row of inserts; and a second reaming row of inserts positioned on said gage face of the cutter further from said gage row than said first reaming row; said second reaming row being in a non-interlocking relationship with said gage row and said first reaming row.

In rolling cutter drill bits the most common arrangement of inserts on a cutter is for all the inserts in each row of inserts to lie at the same radial distance from the axis of rotation of the cutter. However, this is not always the case, and arrangements are sometimes employed where a row of inserts includes inserts which are located at different radial distances from the axis. Accordingly, any reference herein to a "row" or "rows" of inserts is intended to cover both types of arrangement, wherever the context permits, and is not to be understood to mean that all the inserts in the row are necessarily located at the same radius.

A specific embodiment of this invention is a three-cone rolling cutter bit with two cutters having gage insert rows which are interlocked with adjacent inner rows and one cutter having gage insert rows which are "packed". The cutter having a packed gage row has remotely located adjacent inner rows, such that a maximum number of inserts are placed in the gage row without regard to interference from the sockets of adjacent inner row inserts. All three cutters have first and second gage reaming rows positioned in common locations on their gage faces. The insert diameter and socket depth of the first reaming row are reduced to enable interlocking with the gage rows without reducing gage insert count on the packed cutter. The second reaming row is positioned remotely so that it is not interlocked with either the gage or first reaming row. The non-interlock position of the second reaming row enables the use of large diameter reaming inserts to maximize wear-resistant insert surface area on the gage face.

This arrangement provides a maximum amount of wear-resistant insert surface area on the gage face of the cutter to extend the gage life of the bit, while also protecting the gage face from wear near the mouth of the gage insert sockets.

DETAILED DESCRIPTION OF THE PREFERRED EMBODIMENTS

Figure 1:
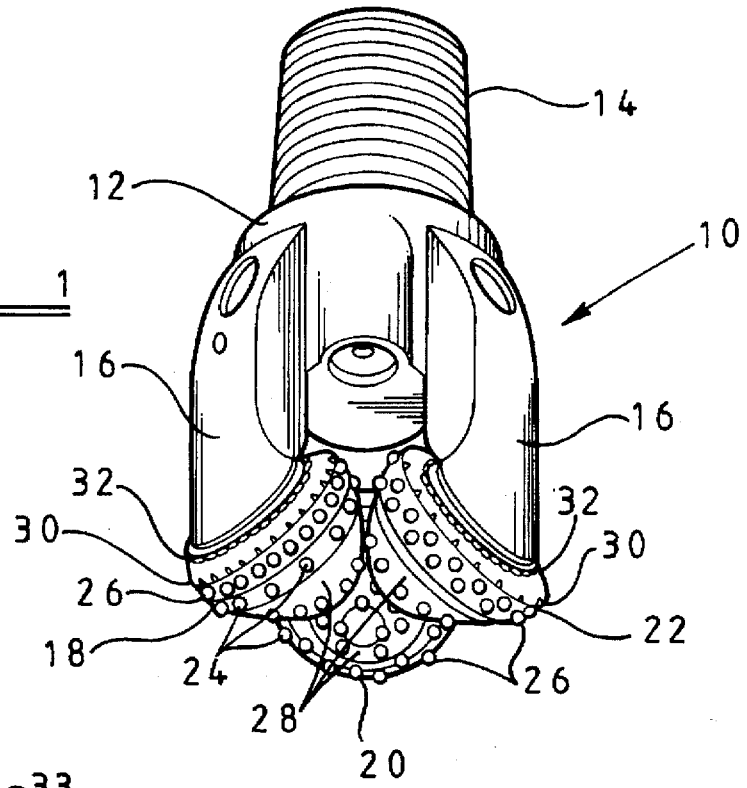
FIG.1 is a perspective view of an insert type rolling cutter drill bit of the present invention.

A perspective view of an insert type rolling cutter drill bit 10 of the present invention is shown in FIG. 1. The bit includes a body member, indicated generally at 12, and a plurality of downwardly extending lugs 16 which support the rolling cone cutters, 18, 20, 22.

Each rolling cone cutter 18, 20, 22 contains a plurality of cutting inserts 24 which are fitted into sockets formed into the surfaces of the cutters 18, 20, 22. Cutting inserts 24 are preferably formed of a hard, wear-resistant material such as tungsten carbide adapted to cut an earthen formation. The inserts 24 are typically arranged in a plurality of rows. The gage rows are indicated generally at 26, the gage reaming rows are indicated at 30 and 32, and the inner rows are indicated generally at 28.

Figure 2:
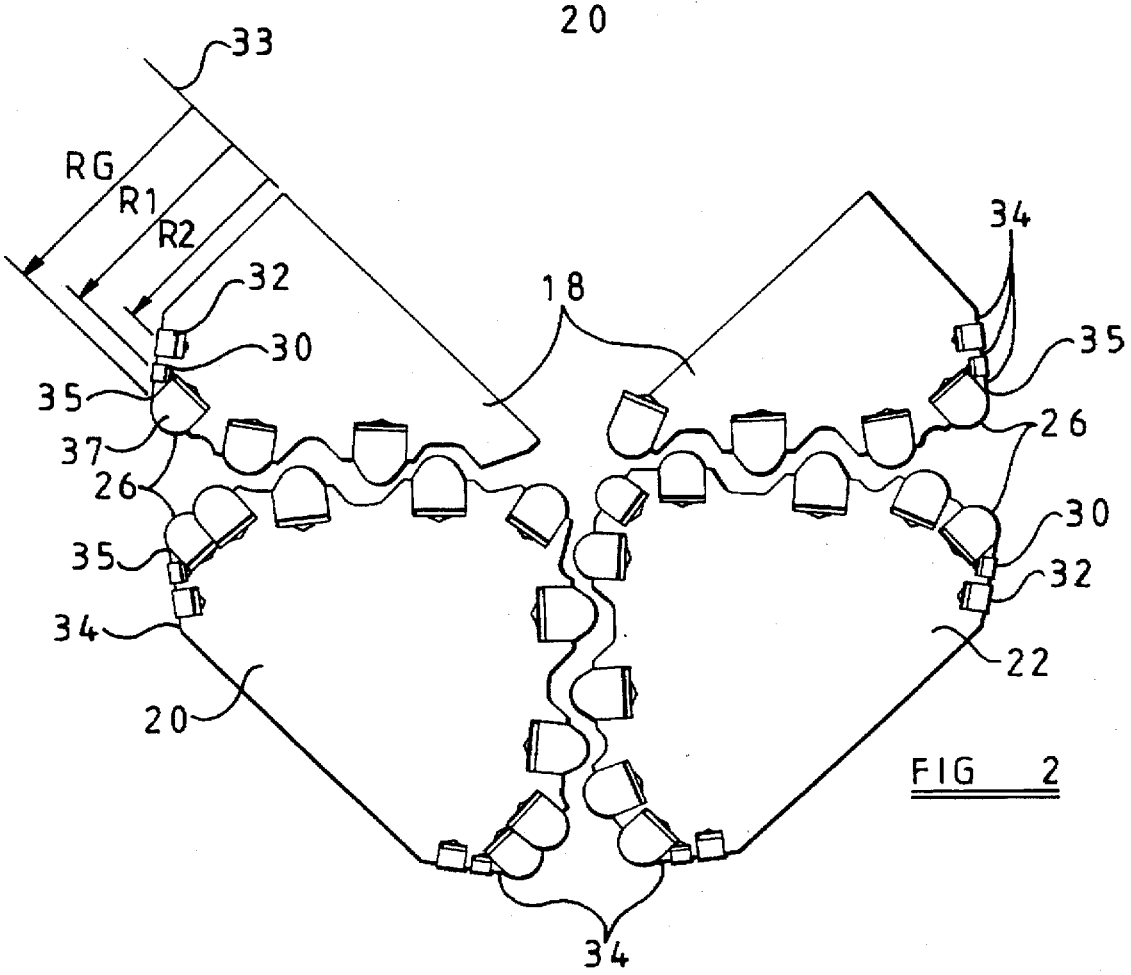
FIG.2 is the assembly view of the intermeshing clearances between the cutters which results from assembly of the bit of the present invention.

The different rows are shown more clearly in the assembly view of FIG. 2. In this view, one of the cutters is split in half to facilitate a scale drawing of the assembly clearances and intermeshing between insert rows resulting from assembly of the bit. The packed gage cutter 18 has a remotely located adjacent inner row, in contrast to the interlocked gage cutters 20 and 22.

A gage row 26 is located on each of the three cutters 18, 20, 22 at a common row radius RG. The row radius RG for the gage row 26 is defined as the radial distance from the rotating centerline 33 of the cutter to a point 37 at the intersection of the external cutter surface and the centerline axis of the insert receiving sockets. The row radii for other rows is defined in similar fashion. A first reaming row 30 is positioned on the gage face 34 of cutter 18 at a row radius R1 such that the inserts are interlocked with the gage row inserts 26. As may be seen from FIGS. 2–4, the inserts of the first reaming row 30 are positioned entirely on the gage face of the cutter, and have exposed gage-reaming surfaces which are exposed only at the gage face of the cutter. Also as shown, each insert of the first reaming row has a central axis which extends at substantially 90° to the gage face. This first reaming row 30 is designed to ream the bottom of the hole sidewall (shown at 38 in FIG. 4) and thereby limit wear of the gage face of the cutter 34 between inserts in gage row 26. The first reaming row 30 is located as close to the gage corner 35 of the cutter as practical while maintaining adequate distance between the insert sockets of gage row 26 and first reaming row 30.

A second reaming row 32 is positioned further away from the gage row 26 at a smaller row radius R2 such that it is non-interlocking with gage row 26 and non-interlocking with first reaming row 30. The second reaming row 32 is designed to provide a maximum amount of wear-resistant reaming insert material on the gage face 34 so that the bit continues to drill a full gage hole after deterioration of the inserts in the gage and first reaming rows 26 and 30.

The first and second reaming rows 30 and 32 are at common row radii R1 and R2 on the gage faces 34 of cutters 20 and 22. Since the spacings between the inserts of gage row 26 are different on each cutter, the distances between the insert sockets in the first reaming row 30 and the sockets of the gage row 26 are different. Typically, the packed cutter 18 will have the smallest distance between gage row 26 insert sockets and first reaming row 30 insert sockets.

Figure 3:
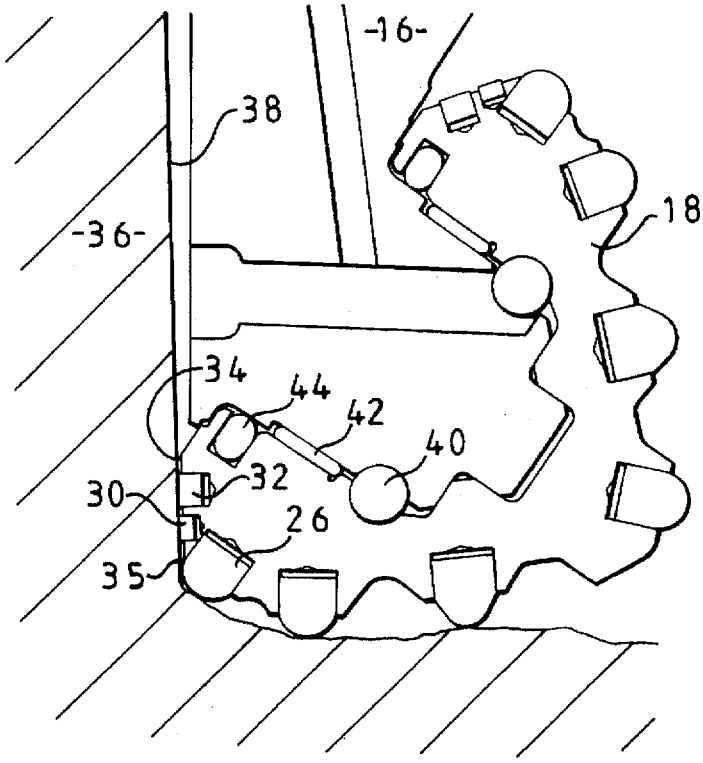
FIG. 3 is a cross-sectional profile view of the preferred embodiment showing a cutter with a packed row.
Figure 4:
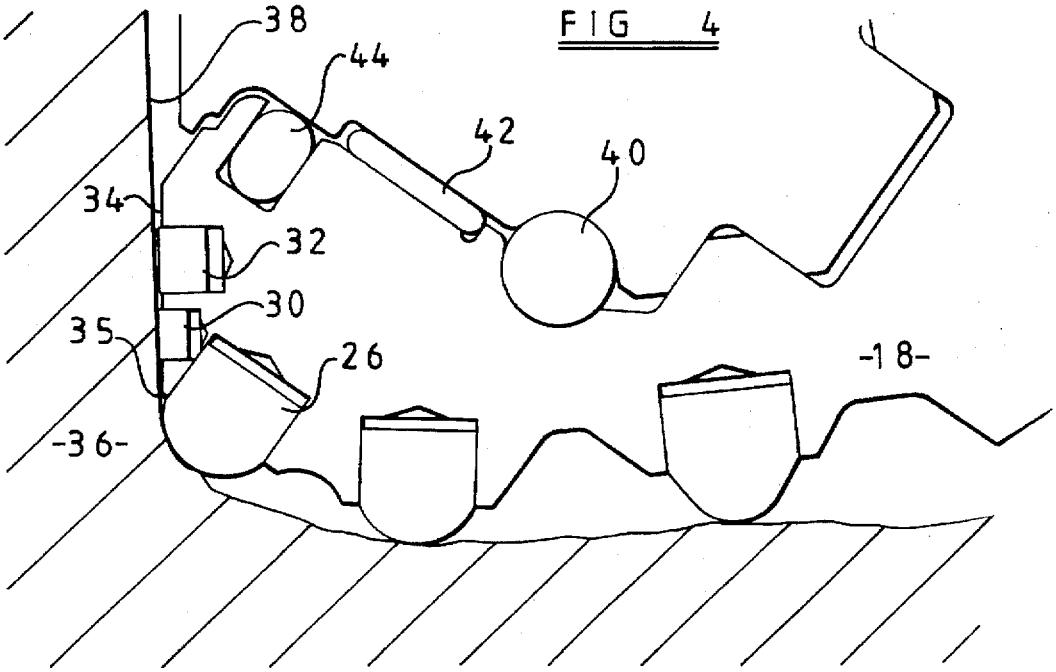
FIG. 4 is an enlargement of the cross section view of FIG. 3 showing the preferred embodiment.

FIGS. 3 and 4 show the construction of gage row 26 and reaming rows 30 and 32 and their relationship to the borehole wall 38 in one preferred embodiment of the invention. The packed cutter 18 is shown because it has the least amount of design space available for reaming row inserts.

Although the centerline of inserts from the different rows of the cutter do not lie in a single plane, inserts of every row have been rotated about the cutter axis so that they all lie within the viewing plane. This allows the designer to view the relative proximity of the insert rows to one another and to view their relationship to the drilled hole bottom and hole wall. The cutter 18 is shown mounted on lug 16. Internal bearing elements 40, 42 facilitate cutter rotation under applied drilling loads. A seal 44 prevents loss of lubricant and ingress of drilling fluids in the cutter 18.

Cutter 18 is made of a carburizing grade of steel, carburized on the internal bearing surfaces, and heat treated to obtain a core yield strength of about 155,000 psi. This strength level is adequate to resist yielding of the insert socket wall while also providing sufficient toughness to resist cracking. Other types of carbon steel may be used, such as a through-hardening grade, provided that they are heat treated to provide similar mechanical properties. The strength and toughness of the cutter steel will typically allow a minimum distance between insert sockets of about 0.050 inch to 0.100 inch, depending upon the size of the inserts and the bit. For example, empirical field testing has shown the minimum acceptable distance between sockets to be about 0.055 inch for cutters on 7⅞ inch diameter bits. Denser packing of insert sockets will result in cracking between sockets under the stress levels typically imposed by insert interference fits and applied drilling loads.

To illustrate the preferred embodiment in a 7⅞ inch diameter bit designed to drill medium to hard formations, the inserts of the first reaming row 30 are 3/16 inch in diameter whereas the inserts of the second reaming row 32 are ¼ inch in diameter. The depth of insert sockets in the first reaming row 30 is 0.157 inch. The depth of insert sockets in the second reaming row 32 is 0.229 inch. The angle between the cutter gage face 34 and the centerline of the cutter is 52 degrees. The gage insert row is at a row radius RG of 2.201 inches. The first reaming row inserts 30 are interlocked with the gage row 26. The first reaming row radius R1 is 2.015 inches. This positions the first reaming row as close to the gage corner 35 as possible while allowing a minimum distance from the gage insert sockets of 0.055 inch. The second reaming row 32 is located on the gage face 34 at a row radius R2 of 1.778 inches. This location provides a minimum distance of 0.055 inch from the gage row 26 and first reaming row 30 as measured in the constructed view of FIG. 4. This arrangement insures a distance of 0.055 inch from any socket in the gage 26 or first reaming row 30, regardless of the spacing and alignment of sockets around the gage surface 34 of the cutter 18.

In this embodiment, the first reaming row radius R1 is nearer to the gage row radius RG than it is to the second reaming row radius R2. This arrangement can be expressed mathematically as $(RG-R1)<(R1-R2)$.

The gage row 26, the first reaming row 30, and the second reaming row 32 have the same locations on cutters 20 and 22 as is shown for cutter 18. However, the distance between the sockets of the gage row 26 and the sockets of first reaming row 30 is 0.200 inch on cutter 20 and 0.157 inch on cutter 22. This is because cutters 20 and 22 have interlocked gage rows 26 with wider spacing between gage insert sockets than the non-interlocked gage row 26 of cutter 18.

Figure 5:
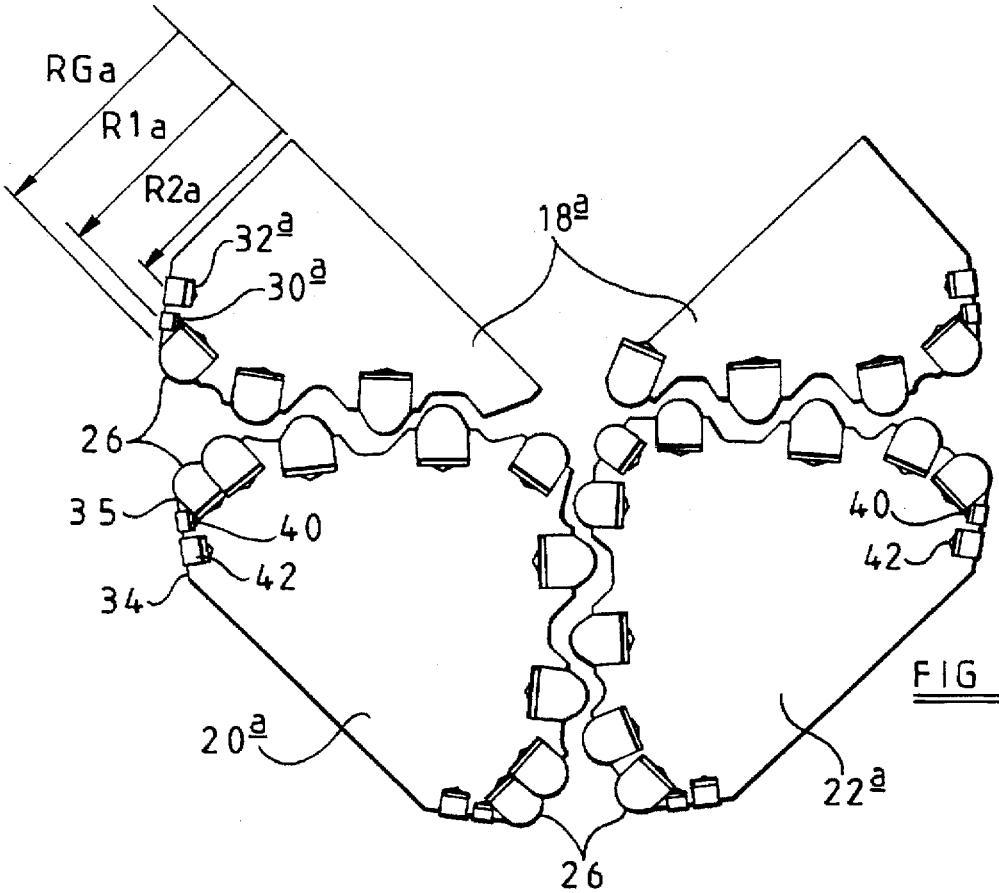
FIG. 5 is an assembly view of a second embodiment.
Figure 6:
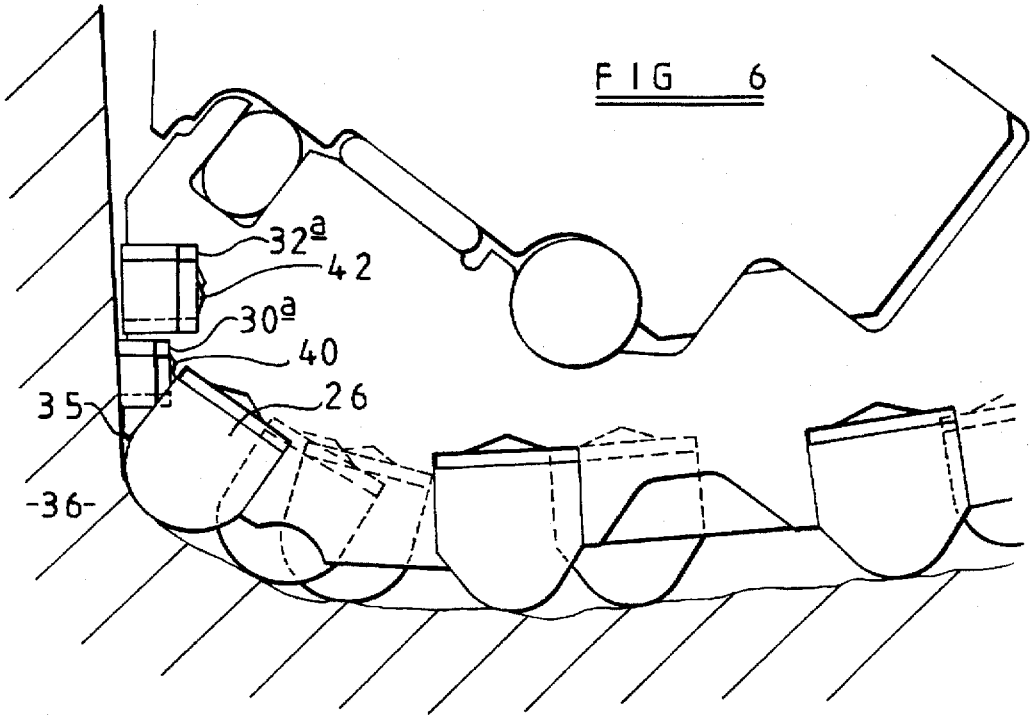
FIG. 6 is a cross-sectional profile view of the second embodiment show in FIG. 5.

An alternative preferred embodiment is shown in FIGS. 5 and 6. All of the insert rows are shown overlaid in the profile view of FIG. 6 to illustrate the spatial relationship of the rows to the hole bottom and to one another. In this design, the first reaming row 40 and second reaming row 42 are located at different positions on each cutter. This takes advantage of the wider spacing between gage inserts on cutter **22*a* to move the reaming rows 40 and 42 closer to the mouth of insert sockets of gage row 26 on cutter 20*a*. With this new position, the minimum distance between gage row 26 sockets and first reaming row 40 sockets is 0.055 "on both cutters 18*a* and 22*a*, even though the spacing of gage inserts is different on cutters 18*a* and 22*a*. Likewise, reaming rows 40 and 42 are positioned closer to the gage corner 35 on cutter 20*a* than on cutter 18*a*. This arrangement provides enhanced wear protection near the gage corner 35** of two of the cutters to minimize erosion at the mouth of the gage insert sockets.

Figure 7:
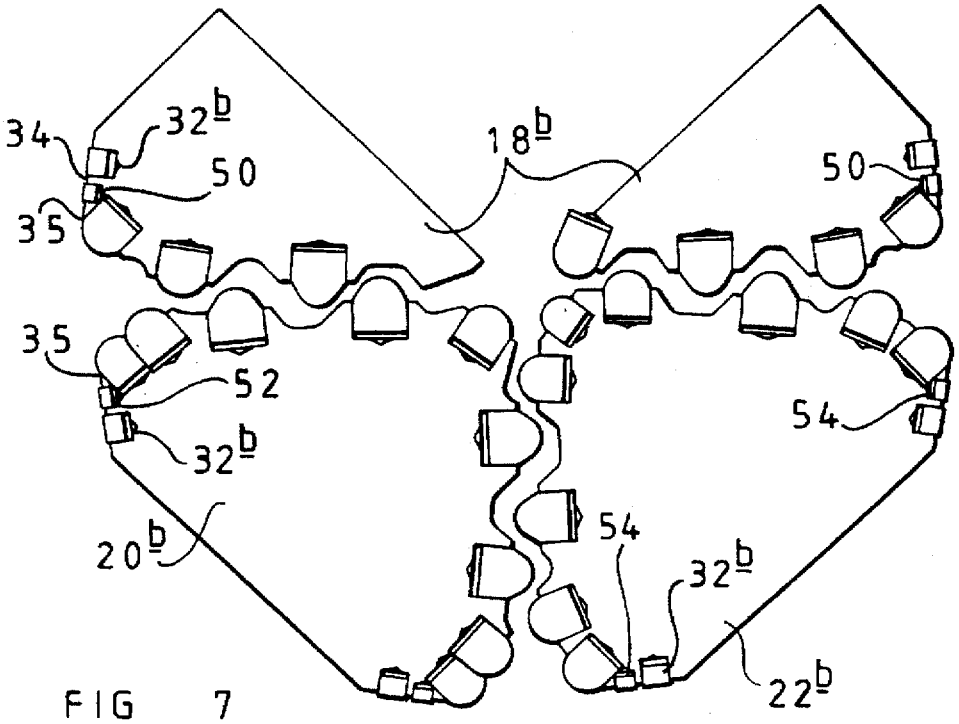
FIG. 7 is a cross-sectional profile view illustrating a third embodiment.

FIG. 7 shows another preferred embodiment where the inserts of first reaming row 50 on packed gage cutter **18*b* are of one diameter, and the inserts of first reaming row 52 on cutters 20*b* and 22*b* are of a different diameter. This design also makes use of the increased spacing between gage inserts of cutters 20*b* and 22*b* to add wear-resistant carbide surface area to gage face surfaces. Each of the first reaming rows 50, 52, and 54 are positioned at a different location on the backface to facilitate the use of different diameter inserts in first reaming rows. Each of the first reaming rows 50, 52, and 54 are interlocked with the gage rows 26 but are not interlocked with the second reaming rows 32*b***.

Figure 8:
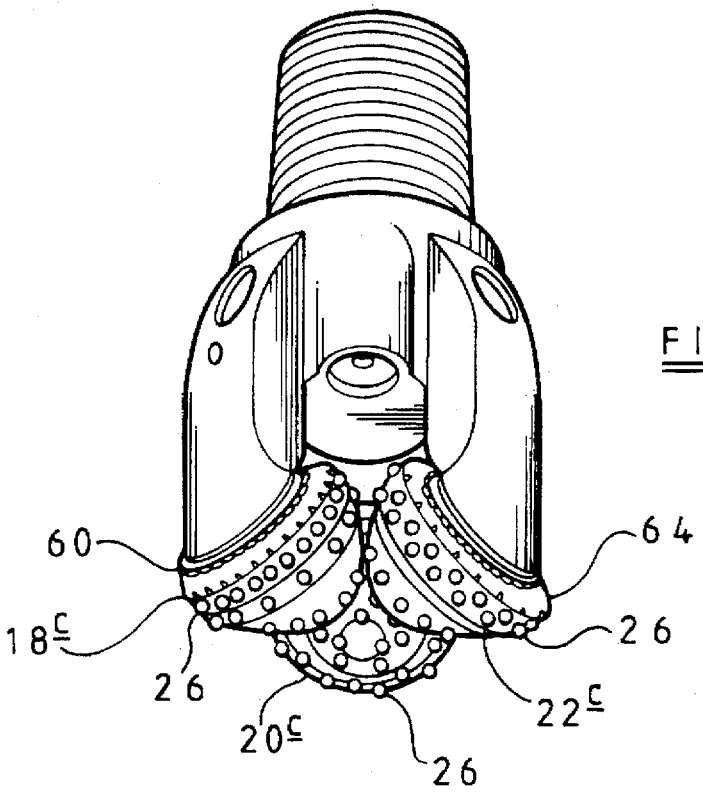
FIG. 8 is a perspective view of a fourth embodiment showing an arrangement of reaming row inserts on the gage face of two of the three cutters of a roller cone bit.

In yet another embodiment, shown in FIG. 8, the inserts of first reaming row 60 on packed gage cutter **18*c* are of the same diameter as the inserts of first reaming rows 62 (not visible) and 64 on interlocked gage cutters 20*c* and 22*c*. However, on cutter 22*c* there are two inserts of first reaming row 64 positioned between adjacent pairs of inserts of gage row 26. Likewise, on cutter 20***c* (not visible) there are two inserts of first reaming row 62 (not visible) positioned between adjacent pairs of inserts of gage row 26. This design also adds wear-resistant carbide surface area to cutter gage faces.

In each of these alternative embodiments, the space available between the widely spaced gage inserts on cutters with interlocked gage rows has been utilized to add additional wear-resistant insert coverage to the gage face of the cutters. Although the first reaming row may be further from gage corner 35 on the packed gage cutter 18, 18*a*, 18*b*, 18*c* than on the other cutters, the narrow spacing of inserts in gage row 26 on cutter 18, 18*a*, 18*b*, 18*c* serves to limit wear of the gage face corner 35. Therefore, a degree of balanced wear resistance is available using different reaming row positions and different reaming row insert diameters for the different cutters.

There is added manufacturing cost required to drill reaming rows and install reaming inserts in different positions and to make reaming inserts of non-common diameters. Therefore, selection of the most cost-effective design depends on the abrasive severity of the drilling environment. In each embodiment shown herein, the first reaming rows are interlocked with the gage rows, while the second reaming rows are not interlocked with either reaming row or the first reaming row. The reaming row inserts of this invention will typically be made of tungsten carbide, but they can be made of any material which is more wear-resistant than the gage face of the cutters. The use of diamond-coated reaming inserts may be particularly beneficial. It may also be beneficial to use inserts in the reaming rows which protrude from the gage face surface of the cutters.

Whereas the description of the present invention has been made in reference to the drawings attached hereto, it should be understood that other and further modifications, apart from those shown or suggested herein, may be made within the scope and spirit of the present invention.

What is claimed:

1. A rolling cutter drill bit for forming bore holes in earthen formations having a plurality of rolling cone cutters, at least one of said cutters having a gage face adapted to engage the sidewall of the bore hole, said one of said cutters having multiple rows of inserts retained in receiving sockets on the outer surfaces of the cutter, including: a gage row of inserts positioned adjacent to said gage face to engage the outer periphery of the hole bottom; a fast reaming row of inserts positioned entirely on said gage face of said cutter in an interlocking relationship with said gage row of inserts; and a second reaming row of inserts positioned on said gage face of the cutter further from said gage row than said first reaming row; said second reaming row being in a non-interlocking relationship with said gage row and said first reaming row, the inserts of the first reaming row having exposed gage-reaming, wear-resistant surfaces, the whole of which surfaces are exposed only at the gage face of the cutter.

2. A rolling cutter drill bit of claim 1 where the number of inserts in said second reaming row is more than the number of inserts in said first reaming row.

3. A rolling cutter drill bit of claim 1 where said second reaming row inserts are larger in diameter than said first reaming row inserts.

4. A rolling cutter drill bit of claim 1 where the depth of said receiving sockets of said second reaming row is larger than the depth of said receiving sockets of said first reaming row.

5. A rolling cutter drill bit of claim 1 where the majority of said first reaming row inserts are spaced alternately with said gage row inserts.

6. A rolling cutter drill bit of claim 1 where the exposed surface of at least one insert in said first reaming row contains a cutting surface made of diamond material.

7. A rolling cutter drill bit of claim 1 where the exposed surface of at least one insert in said second reaming row contains a cutting surface made of diamond material.

8. A rolling cutter drill bit of claim 1 further including at least one additional row of gage reaming inserts located further from the gage insert row than said second reaming row.

9. A rolling cutter drill bit of claim 1 where said gage row is located at a row radius RG, said first reaming row is located at a row radius R1, and said second reaming row is located at a row radius R2, and where (RG–R1) is less than (R1–R2).

10. A rolling cutter drill bit according to claim 1, wherein each insert of the first reaming row has a central axis which extends at substantially 90° to the gage of the cutter.

11. A rolling cutter drill bit for forming bore holes in earthen formations having a plurality of rolling cone cutters, at least two of said cutters having gage faces adapted to engage the sidewall of the borehole, each of said two cutters having multiple rows of inserts retained in receiving sockets on the outer surfaces of the cutter, each of said two cutters including: a gage row of inserts positioned at the gage corner of the cutter; a first reaming row of inserts positioned entirely on the gage face of the cutter in an interlocking relationship with the gage row of inserts; and a second reaming row of inserts positioned on the gage face of the cutter further from said gage row than said first reaming row; said second reaming row being in a non-interlocking relationship with said gage row and said first reaming row, the inserts of the first reaming row having exposed gage-reaming, wear-resistant surfaces, the whole of which surfaces are exposed only at the gage face of the cutter; and the number of said first reaming row inserts on the first of said two cutters being less than the number of said first reaming row inserts on the second of said two cutters.

12. A rolling cutter drill bit for forming bore holes in earthen formations having a plurality of rolling cone cutters, at least two of said cutters having gage faces adapted to engage the sidewall of the borehole, each of said two cutters having multiple rows of inserts retained in receiving sockets on the outer surfaces of the cutter, each of said two cutters comprising: a gage row of inserts positioned at the gage corner of the cutter; a first reaming row of inserts positioned on the gage face of the cutter in an interlocking relationship with the gage row of inserts; and a second reaming row of inserts positioned on the gage face of the cutter further from said gage row than said first reaming row; said second reaming row being in a non-interlocking relationship with said gage row and said first reaming row; and the diameter of said first reaming row inserts on the first of said two cutters being less than the diameter of said first reaming row inserts on the second of said two cutters.

13. A rolling cutter drill bit for forming bore holes in earthen formations having a plurality of rolling cone cutters, at least one of said cutters having a gage face adapted to engage the sidewall of the bore hole, said one of said cutters having multiple rows of inserts retained in receiving sockets on the outer surfaces of the cutter, including: a gage row of inserts positioned adjacent to said gage face to engage the outer periphery of the hole bottom; a first reaming row of inserts positioned on said gage face of said cutter in an interlocking relationship with said gage row of inserts; and a second reaming row of inserts positioned on said gage face of the cutter further from said gage row than said first reaming row; said second reaming row being in a non-interlocking relationship with said gage row and said first reaming row and said second reaming row inserts being larger in diameter than said first reaming row inserts.

14. A rolling cutter drill bit for forming bore holes in earthen formations having a plurality of rolling cone cutters, at least one of said cutters having a gage face adapted to engage the sidewall of the bore hole, said one of said cutters having multiple rows of inserts retained in receiving sockets on the outer surfaces of the cutter, including: a gage row of inserts positioned adjacent to said gage face to engage the outer periphery of the hole bottom; a first reaming row of inserts positioned on said gage face of said cutter in an interlocking relationship with said gage row of inserts; and a second reaming row of inserts positioned on said gage face of the cutter further from said gage row than said first reaming row; said second reaming row being in a non-interlocking relationship with said gage row and said first reaming row, and the depth of said receiving sockets of said second reaming row being larger than the depth of said receiving sockets of said first reaming row.

15. A rolling cutter drill bit for forming bore holes in earthen formations having a plurality of rolling cone cutters, at least one of said cutters having a gage face adapted to engage the sidewall of the bore hole, said one of said cutters having multiple rows of inserts retained in receiving sockets on the outer surfaces of the cutter, including: a gage row of inserts positioned adjacent to said gage face to engage the outer periphery of the hole bottom; a first reaming row of inserts positioned entirely on said gage face of said cutter in an interlocking relationship with said gage row of inserts; and a second reaming row of inserts positioned on said gage face of the cutter further from said gage row than said first reaming row; said second reaming row being in a non-interlocking relationship with said gage row and said first reaming row, the inserts of the first reaming row having exposed gage-reaming, wear-resistant surfaces, the whole of which surfaces are exposed only at the gage face of the cutter, and said non-interlocking relationship between said gage row and said second reaming row comprising a minimum distance between insert sockets of said gage row and insert sockets of said second reaming row of at least 0.050 inch.

16. A rolling cutter drill bit for forming bore holes in earthen formations having a plurality of rolling cone cutters, at least one of said cutters having a gage face adapted to engage the sidewall of the bore hole, said one of said cutters having multiple rows of inserts retained in receiving sockets on the outer surfaces of the cutter, including: a gage row of inserts positioned adjacent to said gage face to engage the outer periphery of the hole bottom; a first reaming row of inserts positioned entirely on said gage face of said cutter in an interlocking relationship with said gage row of inserts; and a second reaming row of inserts positioned on said gage face of the cutter further from said gage row than said first reaming row; said second reaming row being in a non-interlocking relationship with said gage row and said first reaming row, the inserts of the first reaming row having exposed gage-reaming, wear-resistant surfaces, the whole of which surfaces are exposed only at the gage face of the cutter, and said non-interlocking relationship between said first reaming row and said second reaming row comprises a minimum distance between insert sockets of said first reaming row and insert sockets of said second reaming row of at least 0.050 inch.

* * * * *